US006105680A

United States Patent [19]

High

[11] Patent Number: 6,105,680

[45] Date of Patent: Aug. 22, 2000

[54] LOCKING DEVICE FOR A SPRING TRIP MECHANISM

[75] Inventor: Bradley R. High, Sanford, N.C.

[73] Assignee: Caterpillar S.A.R.L., Geneva, Switzerland

[21] Appl. No.: 09/322,408

[22] Filed: May 28, 1999

[51] Int. Cl.[7] ..... E01H 5/04

[52] U.S. Cl. ..... 172/264; 172/414; 37/232

[58] Field of Search ..... 37/232, 266, 233; 172/261, 262, 225, 266, 267, 264, 414, 705

[56] References Cited

U.S. PATENT DOCUMENTS

| | | | |
|---|---|---|---|
| 3,626,614 | 12/1971 | Kahlbacher | 172/261 |
| 3,775,877 | 12/1973 | Gove, Sr. | 172/264 X |
| 3,845,577 | 11/1974 | Naymik | 172/806 X |
| 4,031,966 | 6/1977 | Farrell | 172/794 |
| 4,054,177 | 10/1977 | Quanbeck | 172/267 |
| 4,068,723 | 1/1978 | Quanbeck | 172/267 |
| 4,236,583 | 12/1980 | Geurts | 172/266 |
| 4,312,407 | 1/1982 | Crosby | 172/261 |
| 4,463,813 | 8/1984 | Long et al. | 172/705 |
| 4,519,461 | 5/1985 | Harden et al. | 172/225 |
| 4,658,519 | 4/1987 | Quenzi | 37/23 |
| 5,154,239 | 10/1992 | Harrell et al. | 172/269 |
| 5,437,113 | 8/1995 | Jones | 37/233 |
| 5,697,172 | 12/1997 | Verseef | 37/232 |
| 5,815,956 | 10/1998 | Lavin et al. | 37/241 |

OTHER PUBLICATIONS

Specification and Parts/Componenets for the Farmers' Factory Company (FFC) Snow/Utility Blades (no date).

*Primary Examiner*—Robert E. Pezzuto
*Attorney, Agent, or Firm*—Diana L. Charlton

[57] ABSTRACT

The present invention includes an angle blade assembly with a blade assembly pivotally connected to a subframe. In certain operating conditions, such as pushing material along the ground, a spring trip mechanism, including a plurality of springs, is connected between the blade assembly and the subframe. The springs are preset at a desired tension therebetween to control the pivotal movement of the blade assembly relative to the subframe when the blade assembly encounters variances in the ground elevation. When the angle blade assembly is used for a different operating function that does not require the spring trip mechanism, a locking device is connected between the blade assembly and the subframe. The locking device restricts the pivotal movement of the blade assembly relative to the subframe and, thereby, disables the control action of the springs. The disablement of the control action of the springs is accomplished without removal of the springs, saving the time and energy of an operator.

6 Claims, 11 Drawing Sheets

LOCKING DEVICE FOR A SPRING TRIP MECHANISM

This invention relates generally to a blade assembly mounted on a frame for use on a work machine. More particularly, the invention relates to the use of a locking device operative with a blade portion of the blade assembly to disable a spring trip mechanism utilized between the blade portion and the frame.

BACKGROUND ART

It is well-known in the prior art to include an angle blade assembly that is attached to a frame of a work machine. In most instances, the angle blade assemblies are designed to perform various functions. Therefore, it is preferable that the angle blade assembly be capable of being raised, lowered, and angled relative to the frame of the work machine to perform the various functions. For example, angle blade assemblies are designed for bulldozing a flat surface wherein material is pushed in front of the angle blade assembly. In other configurations, the angle blade assemblies are designed so that a blade of the angle blade assembly can be angled in one direction or the other with respect to its travel path, thus, directing material to one side or the other of the travel path of the angle blade assembly. During these functions of the angle blade assembly, it is important to provide a trip mechanism so that encounters with raised manhole-lips, cracks and other unexpected obstacles that vary the elevation of the ground may be "cushioned" to protect the surrounding structure of the angle blade assembly. For this purpose, it is well-known to pivotally connect a blade and a frame of the angle blade assembly. The trip mechanism is generally connected between the blade and the frame and utilizes one or more springs that are preset at a desired tension. When the blade encounters the unexpected obstacles, it pivots about the frame in response to the varying ground elevation. Simultaneously, the springs compress or expand responsively to the pivotal movement as allowed by the preset tension, thereby, acting as a control for restricting the relative motion between the blade and the frame.

However, angle blade assemblies may also be used to remove dirt or debris from an area. When the angle blade assemblies are used for this function, the spring trip mechanism is not required. Generally, in order to disable the spring trip mechanism, the springs are removed and metal rods are inserted in place of the springs to restrict the movement between the blade and the frame. The removal the springs is sometimes difficult and time consuming. Therefore, the ability to disable the spring trip mechanism without removal of the springs is desired.

The present invention is directed to overcoming the problems as set forth above.

DISCLOSURE OF THE INVENTION

In one aspect of the present invention, a blade assembly comprises a frame with a tab portion that defines at least one opening therethrough. A blade is pivotally connected to the frame and has a tab portion defining at least one opening therethrough that is coaxial with the respective opening in the tab portion of the frame. At least one spring is disclosed that has first and second ends. The first end of the spring is connected to the opening in the blade and the second end of the spring is connected to the opening in the frame. The spring has a preset tension to control pivotal movement of the blade relative to the frame. A locking device is removably connected between the blade and the frame for restricting the pivotal movement of the blade relative to the frame and disabling the control action of the spring without removal of the spring.

In another aspect of the present invention, a method of switching between a disabled and an enabled spring trip mechanism for a blade assembly is disclosed. The switching method comprises the steps of pivotally connecting a blade and frame of the blade assembly. Next, connecting at least one spring between the blade and the frame. The spring has a preset tension to control the pivotal movement of the blade relative to the frame. Finally, restricting the pivotal movement of the blade relative to the frame so that the control action of the spring is disabled without removal of the spring.

The present invention includes a method of switching between a disabled and an enabled spring trip mechanism for a blade assembly. The blade assembly includes a blade pivotally connected to a frame. At least one spring is connected between the blade and the frame and set at a desired tension to control the pivotal movement of the blade relative to the frame when variances in the ground elevation are encountered. This invention is directed at a locking device that restricts the pivotal movement of the blade relative to the frame so that the control action of the spring is disabled without removal of the spring. The ability to quickly transition between the disabled and the enabled spring trip mechanism without removing the spring saves time and energy for an operator.

BEST MODE FOR CARRYING OUT THE INVENTION

Figure 1:
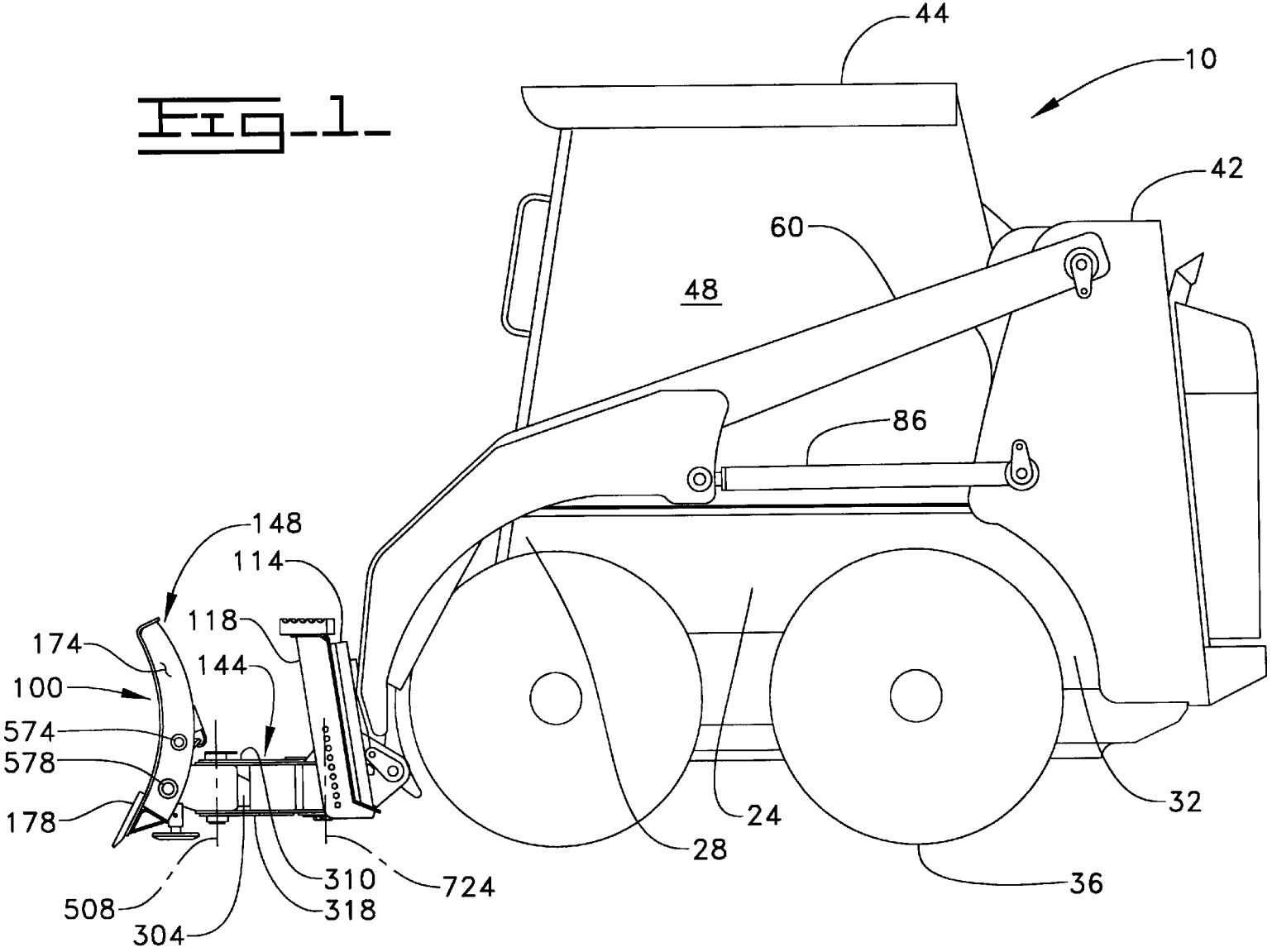
FIG. 1 is a partial side elevational view of a work machine having a coupler assembly for mounting the present invention angle blade assembly.
Figure 2:
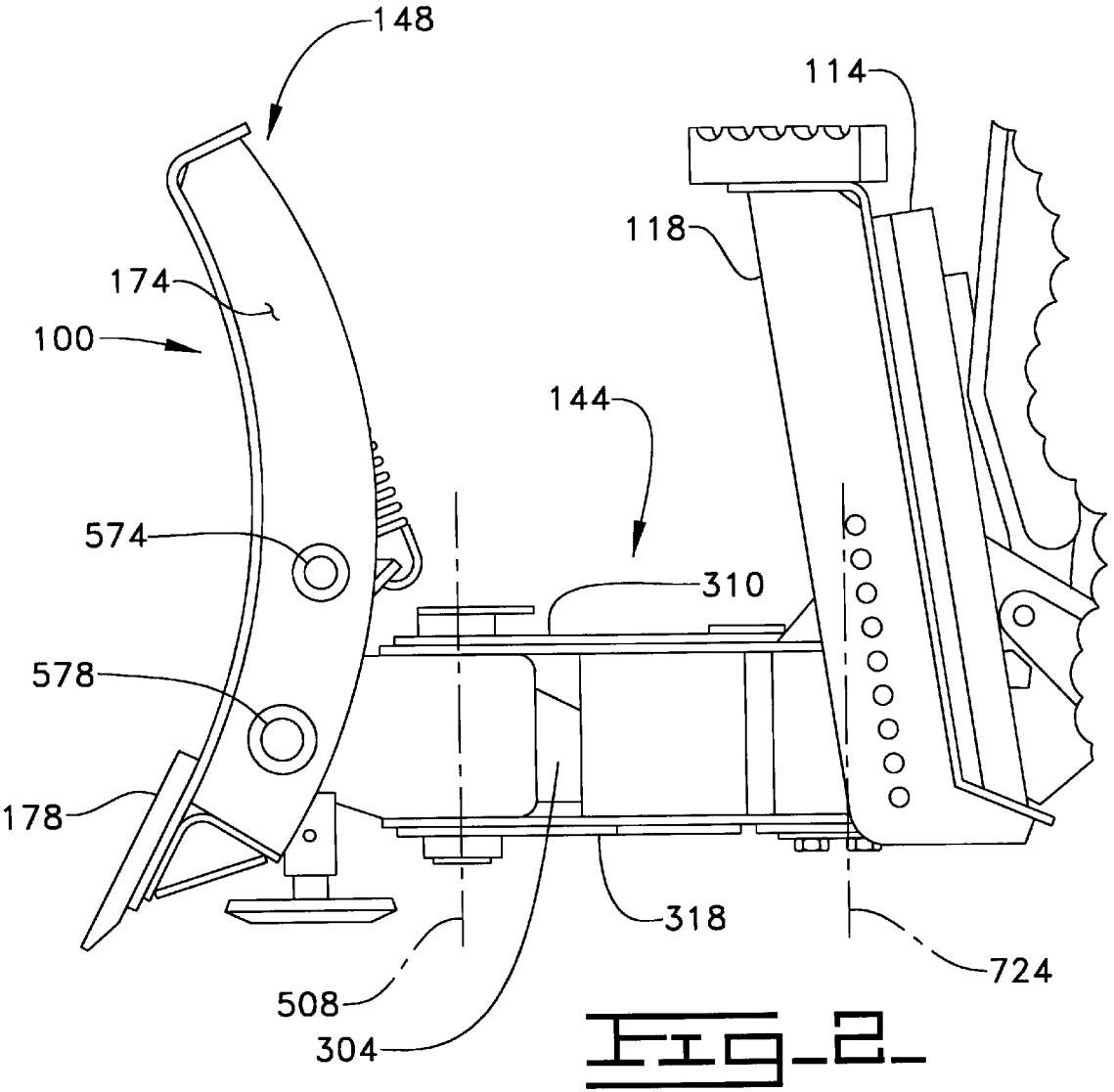
FIG. 2 is a partial side view of the present invention detailed in FIG. 1 shown detached from the work machine.
Figure 3:
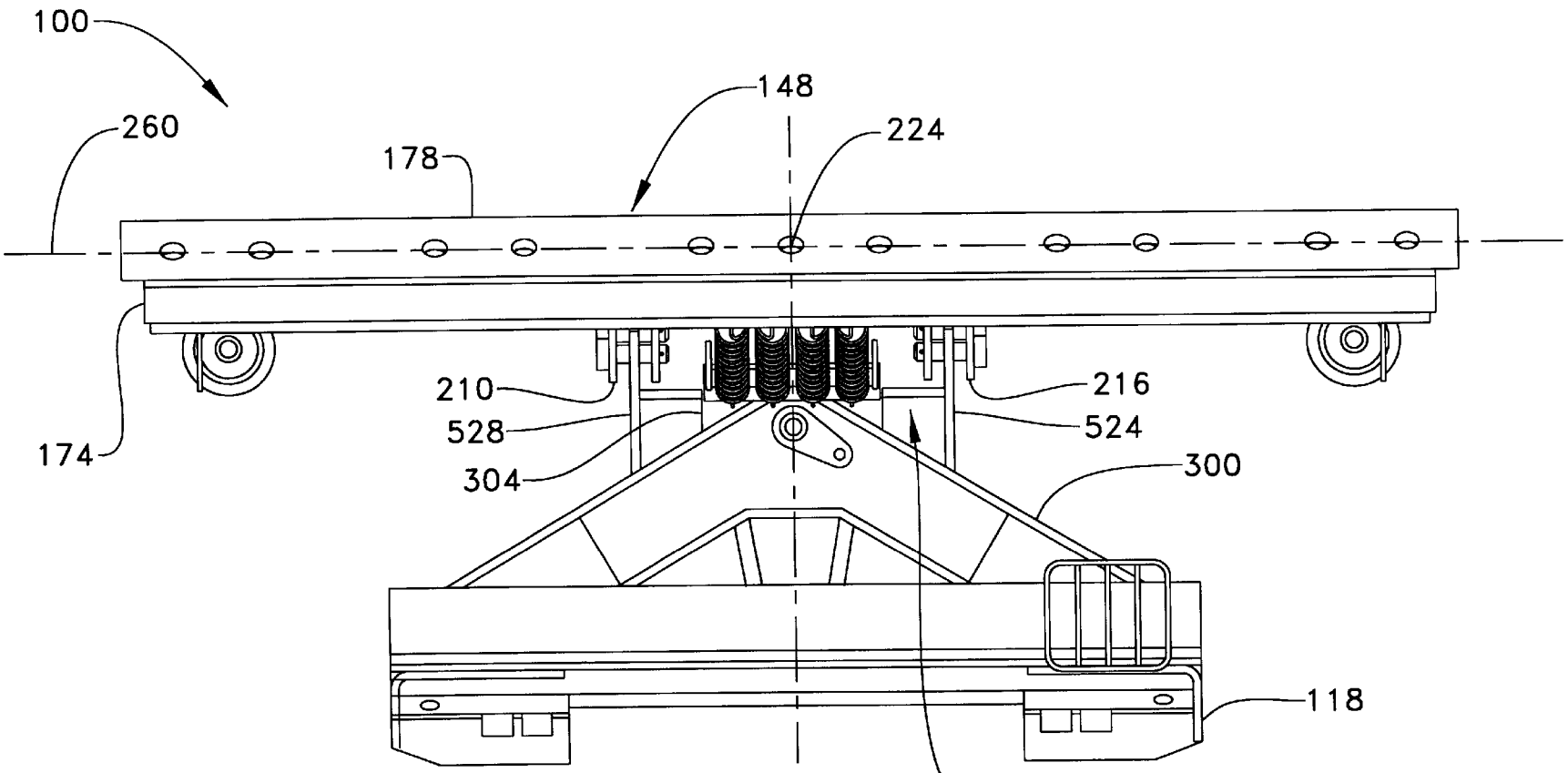
FIG. 3 is a top elevational view of the present invention.
Figure 4:
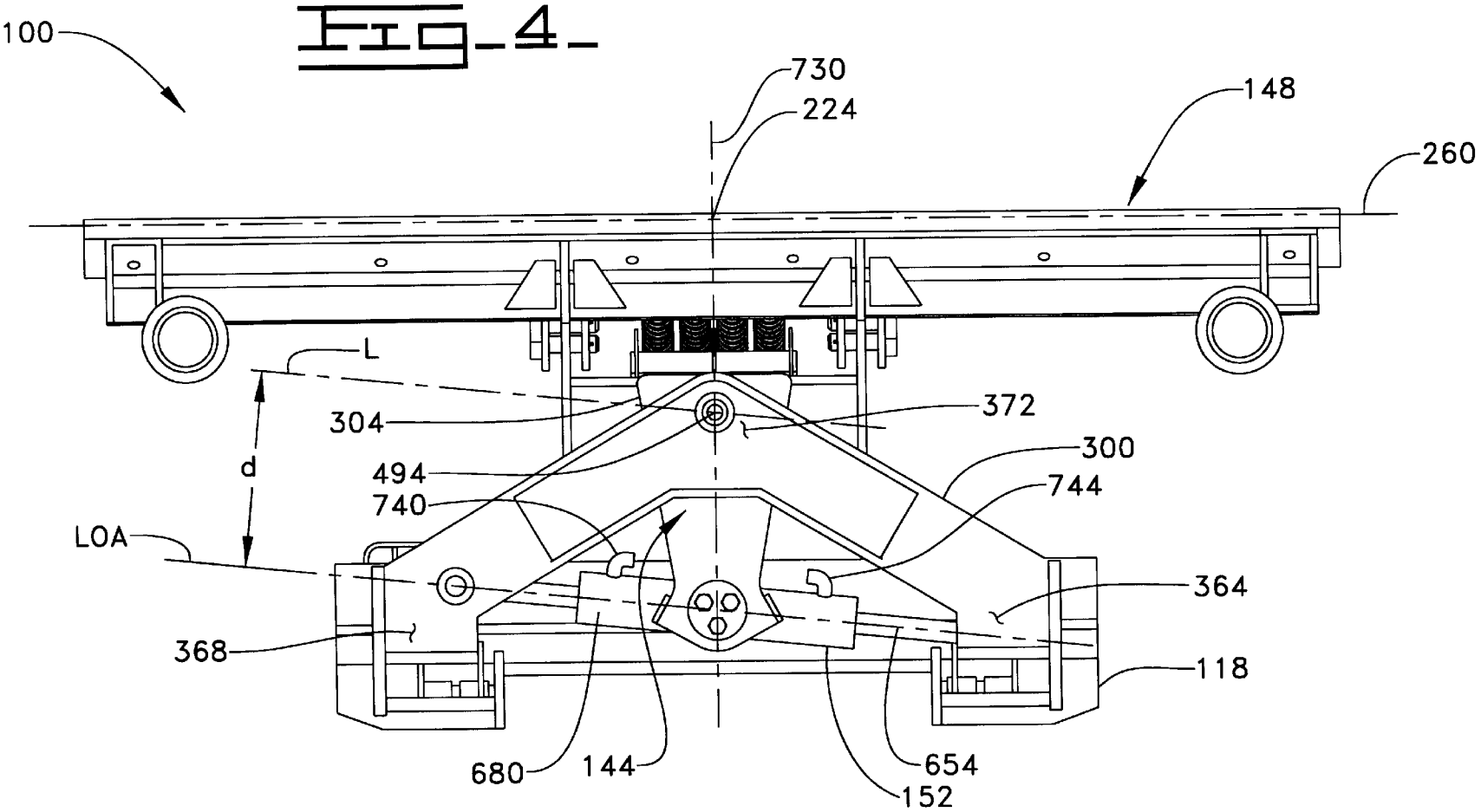
FIG. 4 is a bottom elevational view of the present invention showing a blade at a non-angled position.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, a work machine 10, such as a skid steer loader, is shown incorporating the present invention.

Figure 9:
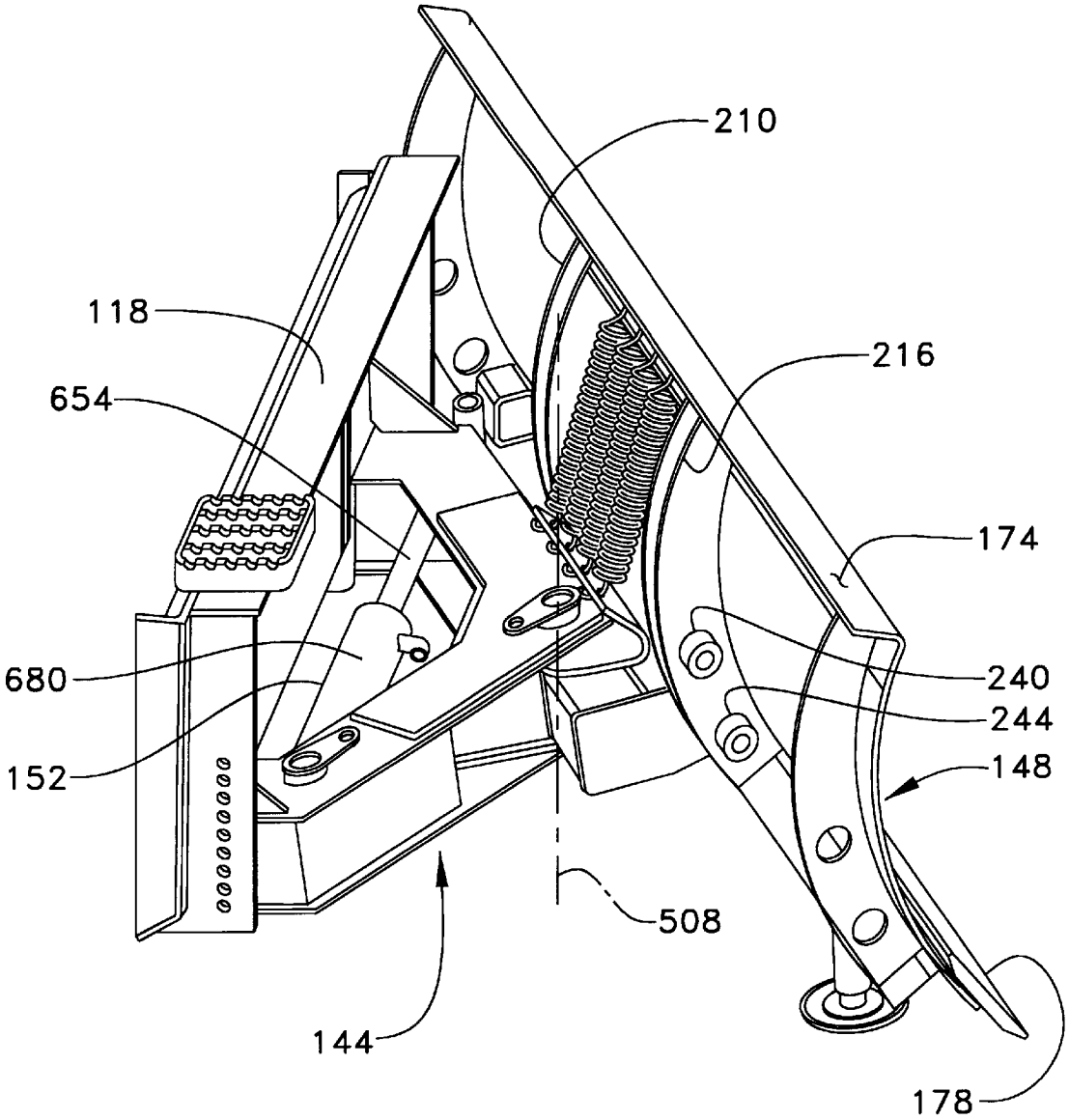
FIG. 9 is a partial perspective view of the present invention detailing the structures shown in FIG. 2.
Figure 10:
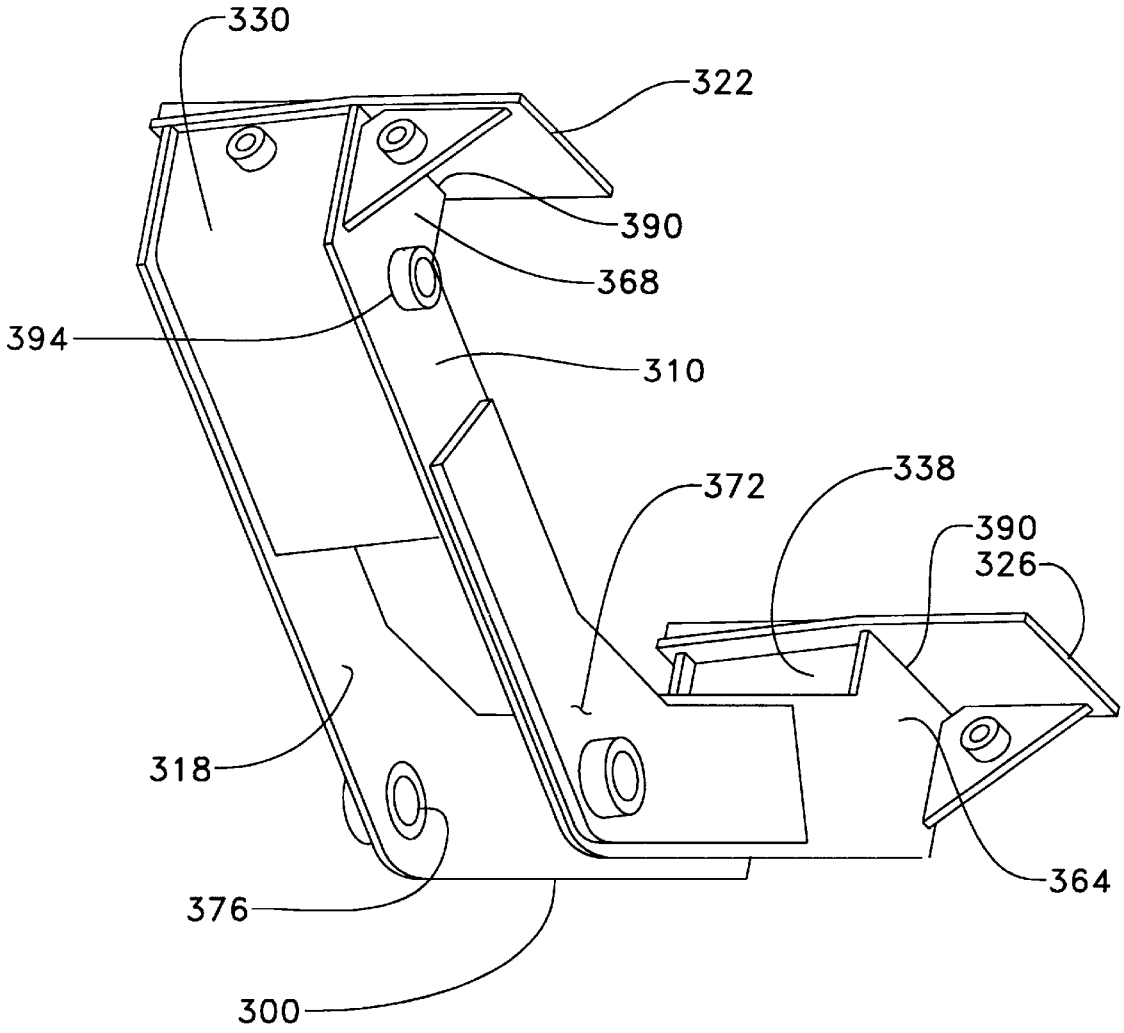
FIG. 10 is a perspective view of a connecting portion for a subframe of the present invention.

The work machine 10 includes a frame 24 with front and rear end portions 28,32 supported by a plurality of wheels 36. The frame 24 includes left and right upright tower assemblies, one of which is shown at 42, that are positioned on the rear end portion 32 thereof. A cab 44 is mounted on the front end portion 28 of the frame 24 for partially enclosing an operator (not shown) within an operating compartment 48. Left and right liftarm assemblies, one of which is shown at 60, are pivotally mounted to the respective corresponding left and right tower assemblies 42 for movement between lowered and raised positions. A pair of any suitable type of lift actuators, one of which is shown at 86, are used to lower and raise the respective corresponding left and right liftarm assemblies 60. An attachment, such as a pivotal angle blade assembly 100, is connected to the frame 24 of the work machine 10 through a coupler 114 attached to the liftarm assemblies 60. It should be understood that the angle blade assembly 100 may be directly or indirectly attached to the coupler 114 or the frame 24 of the work machine 10 by one or more of a plurality of connecting means, such as an interface 118, shown more clearly in FIG. 9.

The angle blade assembly 100, seen more clearly in FIGS. 2–9, includes a subframe assembly 144, a blade assembly 148, and an actuating cylinder 152. The blade assembly 148 is mounted for pivotal movement with the subframe assembly 144 between right and left angled positions 162,168, respectively, shown in FIGS. 5 and 6, as referenced from a machine centerline (not shown). The blade assembly 148, seen best in FIGS. 7 and 9, includes a strengthening portion 174 and a blade 178 extending from the strengthening portion 174 in a conventional manner. The strengthening portion 174 has a plurality of structural members connected thereto including first and second pairs of curved connecting plates 210,216, respectively. Each of the pair of connecting plates 210,216 are located on opposite sides of a midpoint 224 (seen best in FIG. 3) of the blade 178 and extend rearwardly from the strengthening portion 174. Each of the pair of connecting plates 210,216 are spaced in such a manner to define a pair of pin openings therebetween 240,244. A tab assembly 250 is connected to the strengthening portion 174 and is located between the first and second pair of connecting plates 210,216. The tab assembly 250 includes a first plate 252 mounted in any suitable manner, such as through bolts 254, to the strengthening portion 174. A second plate 256 is connected to the first plate 252 in any suitable manner, such as welding, and is angled from the first plate 252 and extends outwardly therefrom. A plurality of openings 258 are defined through the second plate 256. The blade assembly 148 has a longitudinal axis 260 extending along the length of the blade 178, as seen in FIGS. 3–6.

Referring to FIGS. 2–11, the subframe 144 includes a substantially triangular shaped connecting portion 300 and a lever portion 304 connected between the connecting portion 300 and the blade assembly 148 in a manner detailed below. The connecting portion 300 is formed from upper and lower plates 310,318 joined by face plates 322,326, outer side plates, one of which is shown at 330, and inner side plates 334,338, seen more clearly in FIGS. 7–8 and 10. Inner side plate 334 includes a cut-out tab portion 340 that defines a space 352 between the inner side plate 334 and respective rear side plate 330. Referring to FIGS. 4–8 and 10, the plates 310,318 of the connecting portion 300 each have a pair of legs 364,368 which extend from a summit 372 at a location that defines a first coaxial pin opening 376 (seen best in FIG. 10) between the upper and lower plates 310,318 and terminate at a respective base 390. The pin opening 376 is located substantially at a midpoint between the pair of legs 364,368. A second coaxial pin opening 394 (seen best in FIGS. 7 and 10) is defined between the upper and lower plates 310,318 at leg 368 adjacent the space 352.

Figure 5:
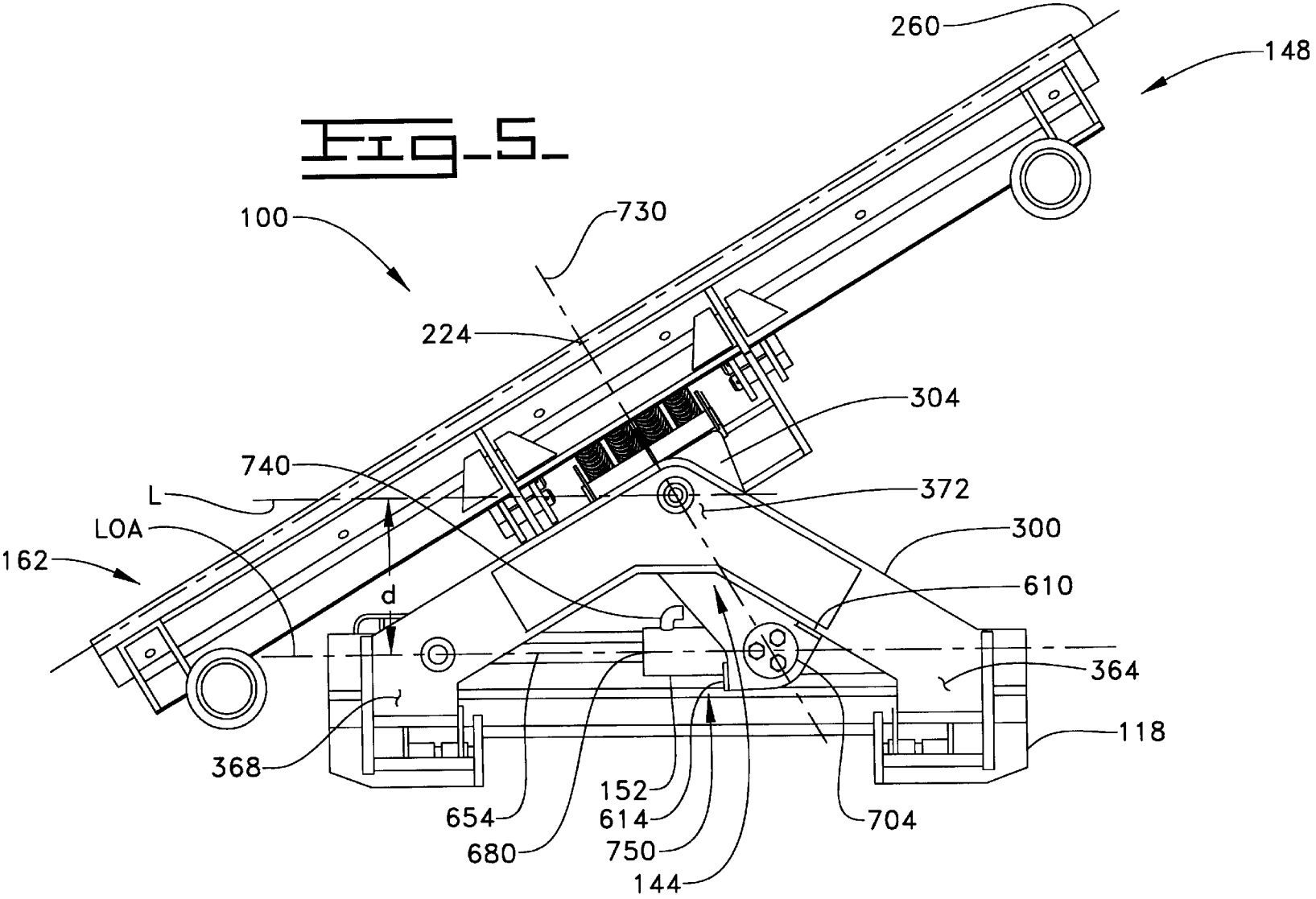
FIGS. 5 and 6 are bottom elevational views of the present invention showing the blade at extreme angled positions on either side of a centerline of the work machine.
Figure 6:
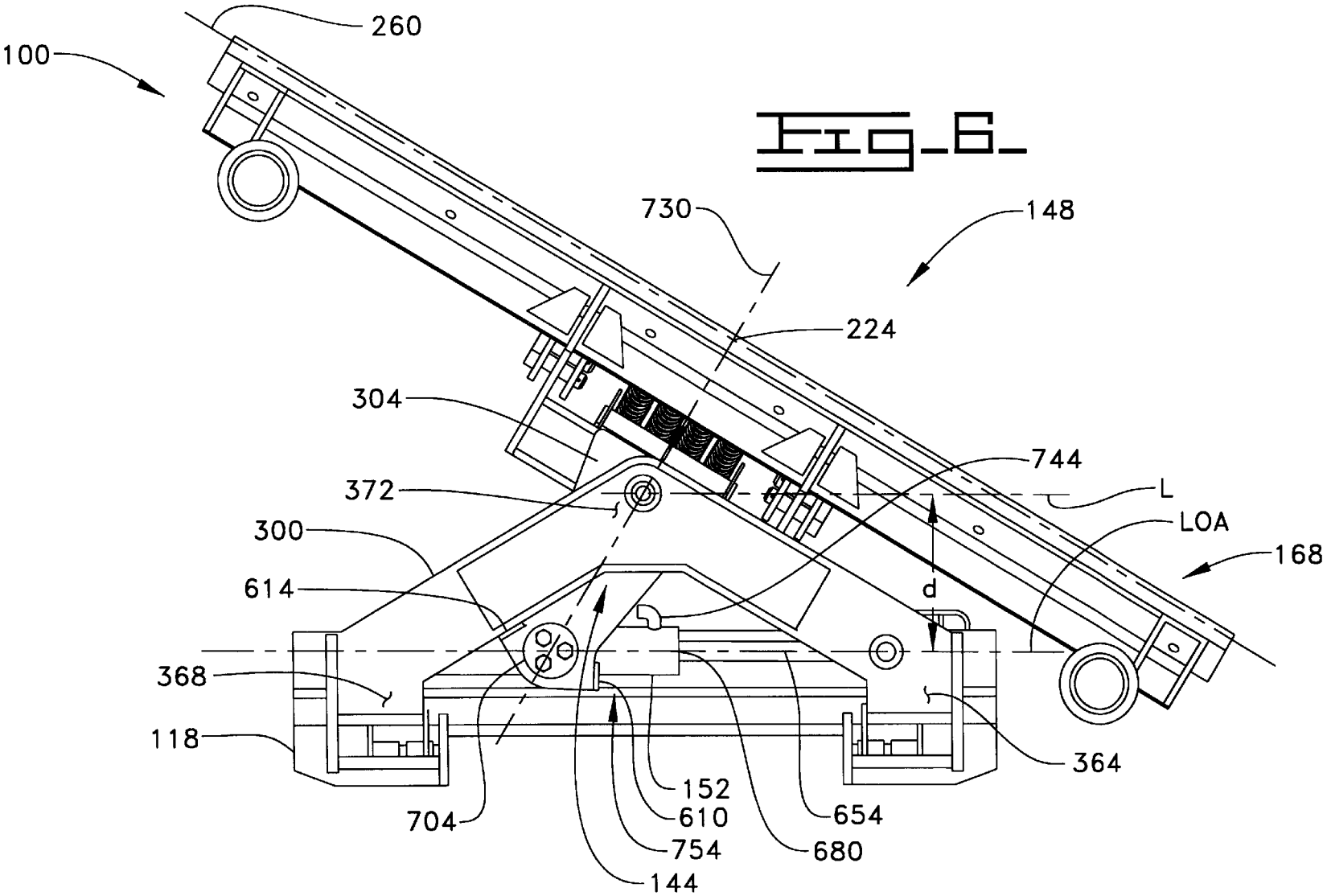
Figure 11:
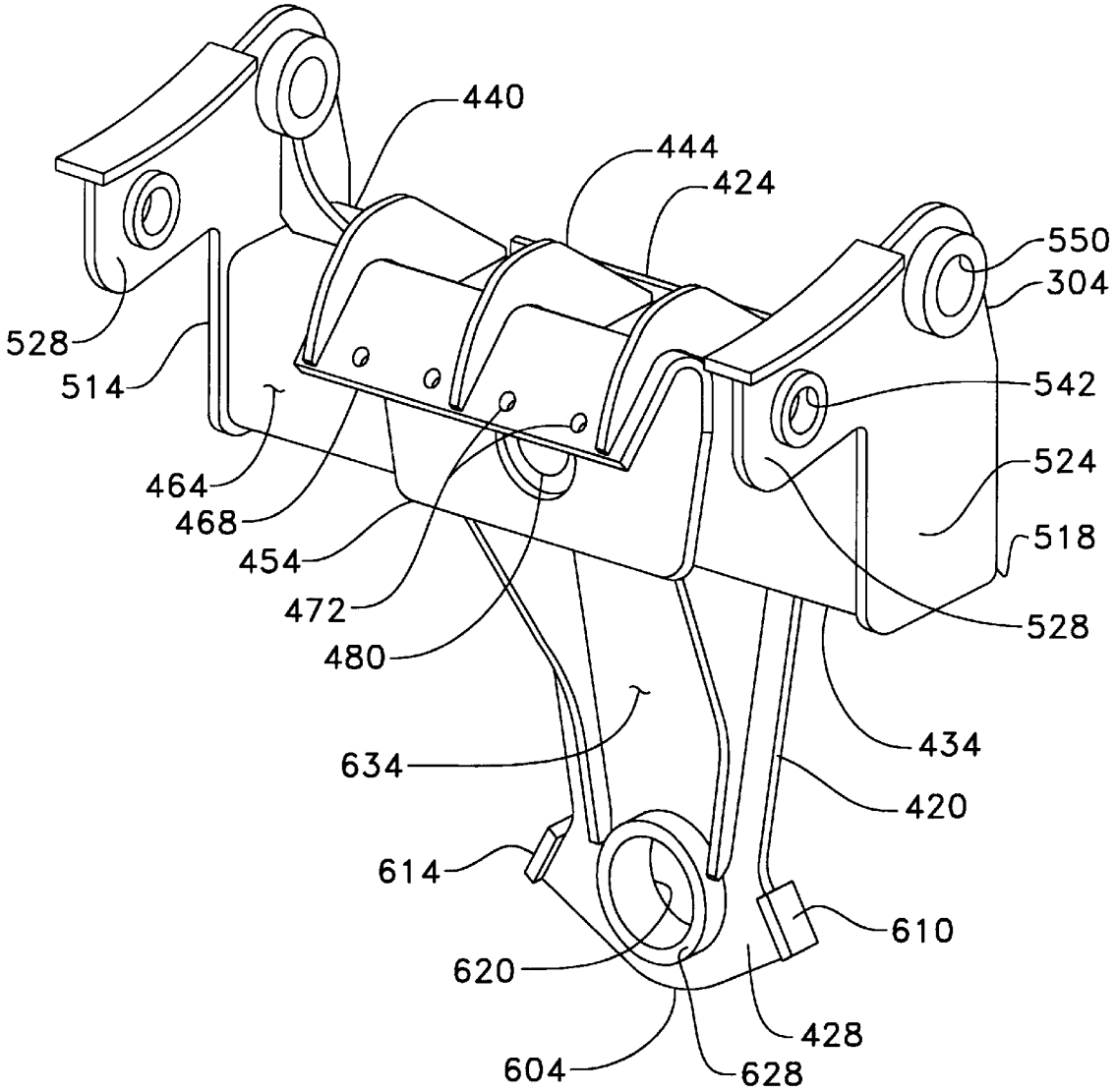
FIG. 11 is a perspective view of a lever portion for the subframe of the present invention.

Referring to FIGS. 1–9 and more specifically to FIG. 11, the lever portion 304 is formed substantially from a triangular shaped pivot plate 420 with base and summit end portions 424,428, respectively, and an elongated channel member 434 extending laterally across and connected at a lower surface 440 to the base end portion 424 of the pivot plate 420 to define a first end 444 of the lever portion 304. Included at the first end 444 of the lever portion 304 is a formed plate 454 connected at an upper surface 464 of the channel member 434. The formed plate 454 has a bent portion 468 extending upwardly away from the upper surface 464 of the channel member 434 with a plurality of openings 472 defined therethrough. A pin opening 480 is defined through the lever portion 304 which extends through the base end portion 424 of the pivot plate 420, the channel member 434, and formed plate 454. The lever portion 304 is partially disposed between the upper and lower plates 310, 318 of the connecting portion 300, as seen best in FIG. 1. A pin 494 extends through the pin openings 376,480 of the connecting and lever portion 300,304 to connect the lever portion 304 to the connecting portion 300 in a conventional pin joint design (seen best in FIGS. 4 and 7). The connection between the connecting and lever portions 300,304 defines a primary vertical axis 508 (seen in FIGS. 1 and 9). The primary vertical axis 508 is spaced from the longitudinal axis 260 of the blade assembly 148. A line "L" drawn through the primary vertical axis 508 is parallel with the line of action "LOA" of the actuating cylinder 152 (seen in FIGS. 4–6). The channel member 434 includes a pair of attachment plates 514,518 at opposite ends thereof. As seen more clearly in FIGS. 7 and 11, the attachment plates 514,518 have a general L-shape with a body portion 524 and arm portion 528 extending from the body portion 524 at a distance from the channel member 434. Locking pin and pivot pin openings 542,550 are defined coaxially through each of the body and arm portions 524,528 of the attachment plates 514,518, respectively. The attachment plates 514,518 are connected between a respective one of the pairs of connecting plates 210,216 by a pair of locking and pivot pins 574,578 extending through the respective pin openings 240,244,542,550 and held therein in any suitable manner so that the subframe 144 and blade assembly 148 are connected. The connection of the pins 574,578 through the pin openings 240,244,542,550 define respective locking and pivot pin joints 590,594. Additionally, the connection between the subframe 144 and the blade assembly 148 defines a spatial relationship between the blade 178 and channel member 434 with the blade 178 and channel member 434 positioned substantially parallel to one another, as seen in FIGS. 3–6. A spring trip mechanism 600, such as a plurality of biasing springs, extend between the blade assembly 148 and subframe 144, as seen best in FIG. 7. Each of the biasing springs 600 are connected at a first end 601 to one of the plurality of openings 258 in the second plate 256 of the tab assembly 250 and at a second end 602 to one of the plurality of openings 472 in the formed plate 454 of the lever portion 304 to allow for elevational adjustment between the ground (not shown) and the blade 178. Referring to FIGS. 5–6 and 11, the summit end portion 428 of the pivot plate 420 defines a second end 604 of the lever portion 304 and diverges outwardly to define a pair of opposed stops 610,614. A pin opening 620 is defined through the pivot plate 420 that extends through the summit end portion 428 and is disposed between the stops 610,614. A boss 628 circumferentially surrounds the pin opening 620 and extends outwardly from a lower surface 634 of the pivot plate 420.

Figure 7:
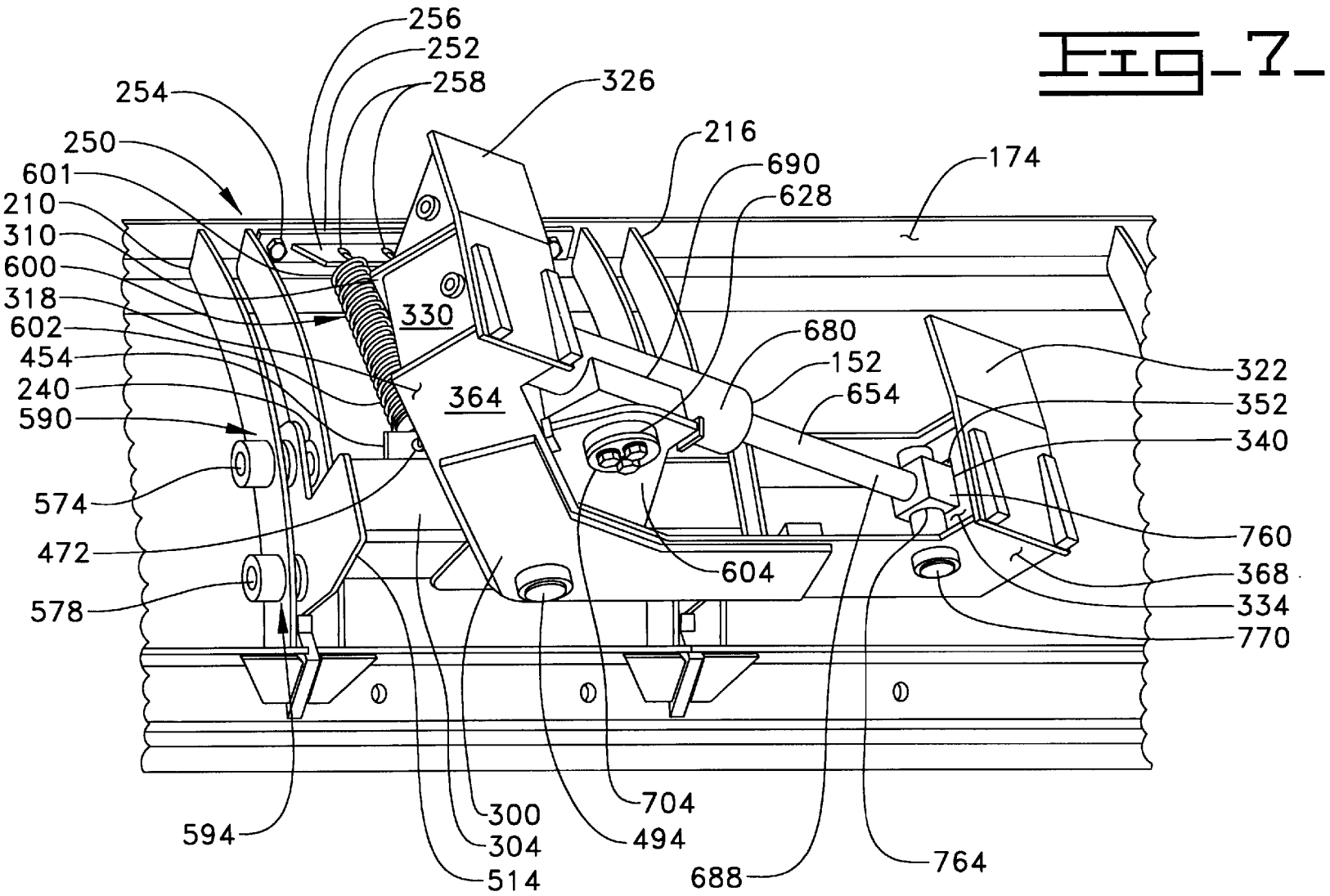
FIGS. 7 and 8 are partial perspective views of the present invention detailing the connection of an actuating cylinder thereof.
Figure 8:
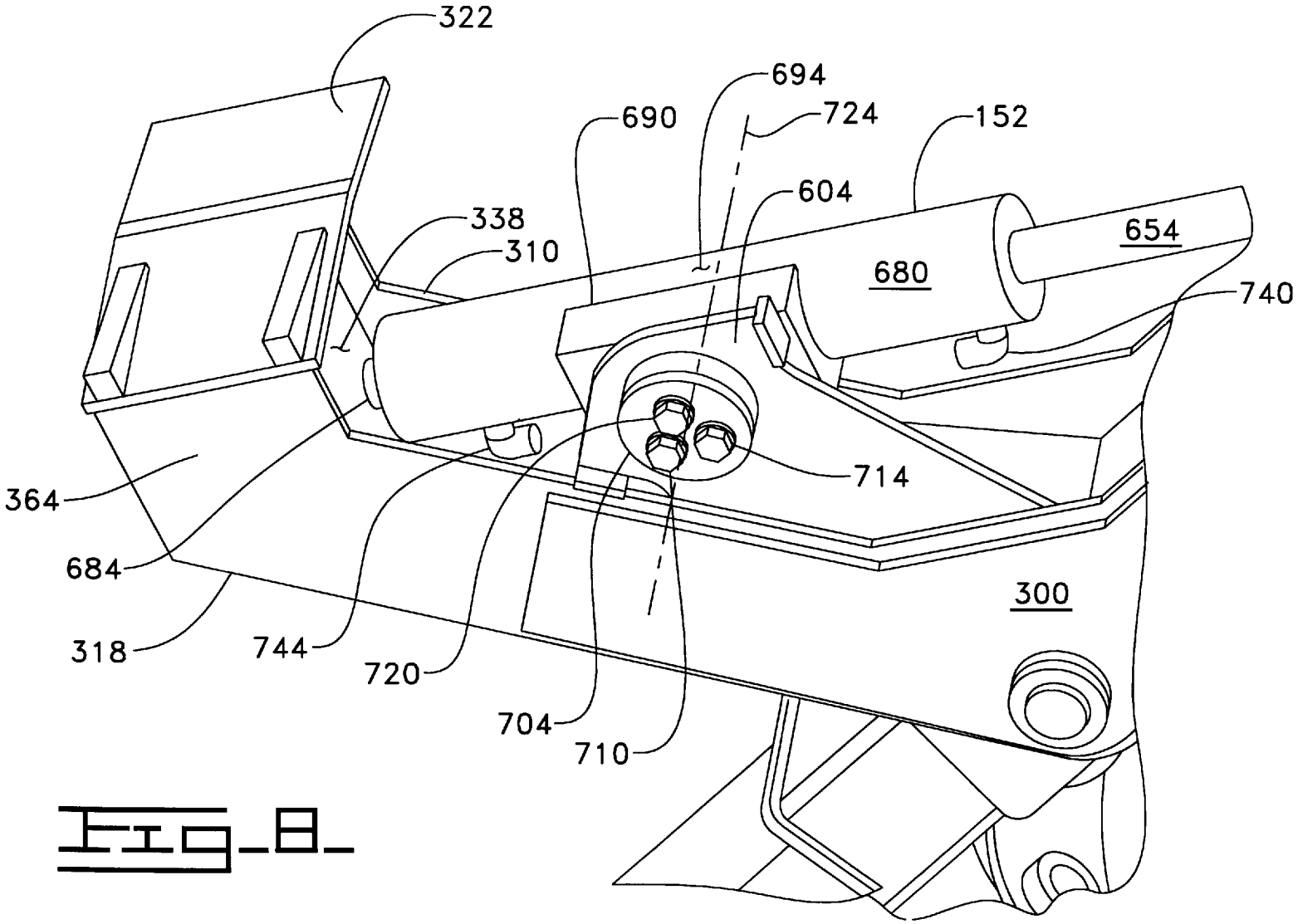

Referring to FIGS. 1 and 4–9, the actuating cylinder 152 is of a double acting design with a linearly distending rod portion 654 defining a line of action "LOA" and a housing portion 680 slidingly disposed along the rod portion 654. The rod portion 654 extends between the legs 364,368 of the connecting portion 300 and includes a free end 684, seen best in FIG. 8, and a connecting end 688, seen best in FIG. 7. Referring more specifically again to FIGS. 7–8, a mounting member 690 is connected in any suitable manner to the housing portion 680 at a central location 694 thereof. The mounting member 690 is connected to the second end 604 of the lever portion 304 by a pin (not shown) that extends through the pin opening 620. A cap 704 is seated on the boss 628 to hold the pin (not shown) within the pin opening 620 via a pair of bolts 710,714. The pin (not shown) is held in a fixed position with the cylinder 152 through any suitable means, such as a bolt 720 extending from the cap 704 and terminating within the mounting member 690. The connection between the mounting member 690 and the lever portion 304 defines a secondary vertical axis 724, seen in FIGS. 1 and 8. A plane 730 is defined that extends through the primary and secondary vertical axes 508,724 and is perpendicular with the longitudinal axis 260 of the blade 178, as seen best in FIGS. 4–6. The plane 730 intersects the blade 178 at its midpoint 224. A pair of supply fittings 740,744 are connected in a convention manner to the housing portion 680 at opposed sides of the central location 694. It should be understood that a supply of actuating fluid (not shown) is transferred from a source (not shown) on the work machine 10 to the supply fittings 740,744 via a respective pair of actuating lines (not shown) to move the housing portion 680 in a conventional manner between first and second positions 750,754 along the rod portion 654, seen respectively in FIGS. 5 and 6. As seen in FIG. 7, the connecting end 688 of the rod portion 654 has a connector 760 with a bore 764 therethrough. A portion of the connector 760 is disposed within the space 352 of the connecting portion 300 of the subframe 144 so that the bore 764 and pin opening 394 are coaxially aligned. A pin 770 extends through the pin opening 394 and bore 764 and is held therein in any suitable manner to connect the connecting end 688 of the rod portion 654 to the subframe 144 at a location adjacent the leg 368. As seen in FIG. 8, the free end 684 of the rod portion 654 is positioned proximate the inner side plate 338 adjacent the leg 364.

Industrial Applicability

During operation of the angle blade assembly 100 along the ground (not shown), it is desirable for the springs 600 between the blade assembly 148 and the subframe 144 to be enabled to function as a "trip" to cushion the blade 178 from excessive wear or damage when experiencing ground elevation variances. In order to accomplish this purpose, the springs 600 are connected between the blade assembly 148 and the subframe 144, as described above, and have a preset spring tension. The spring tension is preset by tightening the bolts 254 until the desired spring tension is achieved or in any suitable manner. Additionally, locking pin 574 is removed so that the blade assembly 148 is free to pivot about pivot pin 578. As the ground elevation varies, the springs 600 are tensioned or compressed accordingly as the blade assembly 148 pivots about pivot pin 578. When the angle blade assembly 100 operates to remove dirt and debris, it may be desirable to fix the blade assembly 148 and disable the "trip" capabilities. This is accomplished by re-inserting locking pin 574 through pin openings 240,542 of the blade assembly 148 and lever portion 304 of the subframe 144, respectively. The re-insertion of the locking pin 574 acts to fix the blade assembly 148 relative to the lever portion 304 of the subframe 144. The method of switching between an enabled or a disabled "trip" by removal or insertion, respectively, of the locking pin 574 allows for a quick transition without removal of the springs 600, saving time and energy for the operator (not shown).

The unique connection between the blade assembly 148, connecting and lever portions 300,304 of the subframe 144, and actuating cylinder 152 allows for the pivotal movement of the blade assembly 148 between the right and left angled positions 162,168, as seen in FIGS. 5 and 6, respectively. The pivotal movement is achieved when the operator (not shown) selects an angled position of the blade assembly 148 from inside the cab 44 of the work machine 10. Once the operator (not shown) selects the angled position of the blade assembly 148, a signal is produced which is operatively associated with solenoid valves (not shown), in a conventional manner, to direct a flow of actuating fluid (not shown) through the respective actuating lines (not shown) to the respective supply fitting 740,744 dependent upon the angled position selected. Referring to FIGS. 5 and 6, it should be understood that the addition of actuating fluid through either of the supply fittings 740,744 moves the housing portion 680 of the actuating cylinder 152 between the first and second positions 750,754 to facilitate the pivotal movement of the blade assembly 148. The movement of the housing portion 680 between the first and second positions 750,754 moves the secondary vertical axis 724 substantially about the primary vertical axis 508 so that a constant radius is maintained throughout the angular movement of the blade assembly 148. Throughout the angular movement of the blade assembly 148, the line of action "LOA" of the actuating cylinder 152 maintains a substantially constant distance "d" from the parallel line "L" drawn through the primary vertical axis 508, as seen best in FIGS. 4–6. The ability to substantially maintain the constant distance "d" allows for virtually identical forces to be exerted by the actuating cylinder 152 throughout the angular movement of the blade assembly 148. The ability to pivot the blade assembly 148 in the above manner increases the effectiveness of the design without utilization of complex linkages. More specifically, the singular actuating cylinder 152 works directly with surrounding structural components to achieve the pivotal movement of the blade assembly 148. As seen in FIG. 5, when the housing portion 680 reaches the first position 750, the stop 610 on the lever portion 304 contacts leg 364 in order to prevent further angular movement of the blade assembly 148. Similarly, as seen in FIG. 6, when the housing portion 680 reaches the second position 754, the stop 614 contacts leg 368. These stops 610,614 are provided to limit the pivotal movement of the blade assembly 148 to the most effective ranges of motion.

Other aspects, objects and advantages of this invention can be obtained from a study of the drawings, disclosure and the appended claims.

What is claimed is:

1. A blade assembly, comprising:

a frame having a tab portion defining at least one opening therethrough;

a blade pivotally connected to the frame, the blade having a tab portion defining at least one opening therethrough coaxial with the respective opening in the tab portion of the frame;

at least one spring having first and second ends, the first end connected to the opening in the blade and the second end connected to the opening in the frame at a preset tension to control the pivotal movement of the blade relative to the frame; and a locking device removably connected between the blade and the frame for eliminating the possibility of pivotal movement of the blade relative to the frame and disabling the control action of the spring without removal of the spring.

2. The blade assembly of claim 1, wherein the pivotal connection between the blade and the frame includes a pair of pivot pins extending through the blade and the frame.

3. The blade assembly of claim 2, wherein the locking device includes a pair of lock pins extending through the blade and the frame for fixing the blade to the frame, each one of the pair of lock pins spaced a predetermined distance from a respective one of the pair of pivot pins.

4. A method of switching between a disabled and an enabled spring trip mechanism for a blade assembly, comprising the steps of:

pivotally connecting a blade and frame of the blade assembly;

connecting at least one spring between the blade and the frame, the spring having a preset tension to control the pivotal movement of the blade relative to the frame; and eliminating any possibility for pivotal movement of the blade relative to the frame so that the control action of the spring is disabled without removal of the spring.

5. The method of switching between a disabled and an enabled spring trip mechanism for a blade assembly of claim 4, including the steps of:

utilizing a pair of pivot pins extending through the blade and the frame to allow the pivotal movement of the blade relative to the frame; and utilizing a pair of lock pins extending through the blade and frame in a spaced relationship with the pair of pivot pins to restrict the pivotal movement of the blade relative to the frame.

6. The method of switching between a disabled and an enabled spring trip mechanism for a blade assembly of claim 5, including the step of:

removing the pair of lock pins to allow the pivotal movement of the blade relative to the frame as controlled by the preset tension in the spring.

* * * * *